US005349721A

United States Patent [19]

Iida

[11] Patent Number: 5,349,721

[45] Date of Patent: Sep. 27, 1994

[54] FAN APPARATUS

[75] Inventor: Yosikazu Iida, Tokyo, Japan

[73] Assignee: Kioritz Corporation, Tokyo, Japan

[21] Appl. No.: 18,380

[22] Filed: Feb. 17, 1993

[30] Foreign Application Priority Data

Feb. 18, 1992 [JP] Japan ..... 4-006426[U]

[51] Int. Cl.[5] ..... A47L 5/22

[52] U.S. Cl. ..... 15/330; 15/327.2; 15/405; 15/412

[58] Field of Search ..... 15/327.2, 330, 405, 15/406, 412

[56] References Cited

U.S. PATENT DOCUMENTS

| | | | |
|---|---|---|---|
| Re. 33,050 | 9/1989 | Tuggle et al. . | |
| D. 165,509 | 12/1951 | Calvin | 15/344 |
| D. 263,547 | 3/1982 | Carsello | 15/405 |
| 3,866,263 | 2/1975 | Crouser et al. | 15/412 |
| 4,223,419 | 9/1980 | Sato et al. . | |
| 4,318,203 | 3/1982 | Satoh et al. | 15/344 |
| 4,325,163 | 4/1982 | Mattson et al. . | |
| 4,517,939 | 5/1985 | Kiyooka . | |
| 4,644,606 | 2/1987 | Luerken et al. . | |
| 4,674,146 | 6/1987 | Tuggle et al. . | |
| 4,694,528 | 9/1987 | Comer et al. . | |
| 4,756,668 | 7/1988 | Gassen et al. . | |
| 4,792,286 | 12/1988 | Gassen . | |
| 4,797,072 | 1/1989 | Berfield et al. | 15/405 |
| 4,799,287 | 1/1989 | Belanger et al. | 15/405 |
| 4,913,112 | 4/1990 | Iida . | |
| 5,003,662 | 4/1991 | Everts . | |
| 5,035,586 | 7/1991 | Sadler et al. | 15/405 |
| 5,222,275 | 6/1993 | Baker et al. | 15/405 |

FOREIGN PATENT DOCUMENTS

| | | | |
|---|---|---|---|
| 0430074 | 2/1948 | Italy | 15/406 |

*Primary Examiner*—Timothy F. Simone
*Assistant Examiner*—James F. Hook
*Attorney, Agent, or Firm*—Browdy and Neimark

[57] ABSTRACT

A fan apparatus capable of preventing problems which can be caused during the rotation of a fan rotor, and also capable of facilitating the mounting and dismounting of a suction port cover. The suction port cover removably provided on the same side of the apparatus as an air suction port includes a bell-mouth shaped member for guiding air being sucked into the air suction port in such a manner that air is introduced from the side of the cover, the inner surface of the bell-mouth shaped member defining a first suction passage. A blind patch member is disposed in the space defined by the outer surface of the bell-mouth shaped member with a gap between the blind patch member and an outer surface of the bell-mouth shaped member so that a second suction passage is defined therebetween.

2 Claims, 2 Drawing Sheets

FAN APPARATUS

BACKGROUND OF THE INVENTION

The present invention relates to a fan apparatus having a suction port cover removably provided on one side of the apparatus where a suction port through which a fan of the apparatus sucks air is located, the cover being disposed facing a fan rotor of the fan.

A suction port cover of a fan apparatus of the type described above is provided generally for the purpose of avoiding various problems which can be caused during the rotation of the fan rotor. The cover is provided, for instance, to prevent the risk of an operator getting hurt by contacting the fan in rotation with a finger or any other part of the body, or to prevent the risk of the fan or the other parts of the apparatus being damaged due to contact of the fan in rotation with an object such as a bar. Other problems may be caused even when the fan does not directly contact with an object. For instance, cloth, paper or the like may be drawn under the suction force of the fan, clogging the air suction port for the fan, thereby deteriorating the fan performance, or troubling the engine serving as the power source.

SUMMARY OF THE INVENTION

An object of the present invention is to provide a fan apparatus capable of effectively preventing problems, such as above, which can be caused during the rotation of the fan rotor, and also capable of facilitating the mounting and dismounting of a suction port cover at the time of, for instance, changing the operation of the apparatus from blowing to sucking.

To this end, according to the present invention, there is provided a fan apparatus comprising: a fan rotor; an air suction port for the fan rotor; and a suction port cover removably provided on the same side of the apparatus as the air suction port. The suction port cover comprises: a bell-mouth shaped member for guiding air being sucked into the air suction port in such a manner that air is introduced from the side of the suction port cover, the inner surface of the bell-mouth shaped member defining a first suction passage; and a blind patch member disposed in the space defined by the outer surface of the bell-mouth shaped member with a gap between the blind patch member and an outer surface of the bell-mouth shaped member so that a second suction passage is defined therebetween.

With the fan apparatus according to the present invention, air being sucked into the air suction port is mainly guided by the bell-mouth shaped member of the suction port cover, or the fan cover, in such a manner that air is mainly introduced from the side of the fan cover. With this arrangement, it is possible to prevent problems which can be caused during the rotation of the fan rotor as a result of, for instance, unwanted contact of the rotating fan rotor with objects, or clogging of the air suction port. Furthermore, the blind patch member disposed in the space defined by the outer surface of the bell-mouth shaped member with a gap between the blind patch member and an outer surface of the bell-mouth shaped member may be used as a handhold means, which facilitates the operation of mounting or dismounting the fan cover. The blind patch member is also useful for the prevention of leakage of fanrotation noise through the air suction port, and is able to be used as a space for labelling.

DESCRIPTION OF THE PREFERRED EMBODIMENT

Figure 1:
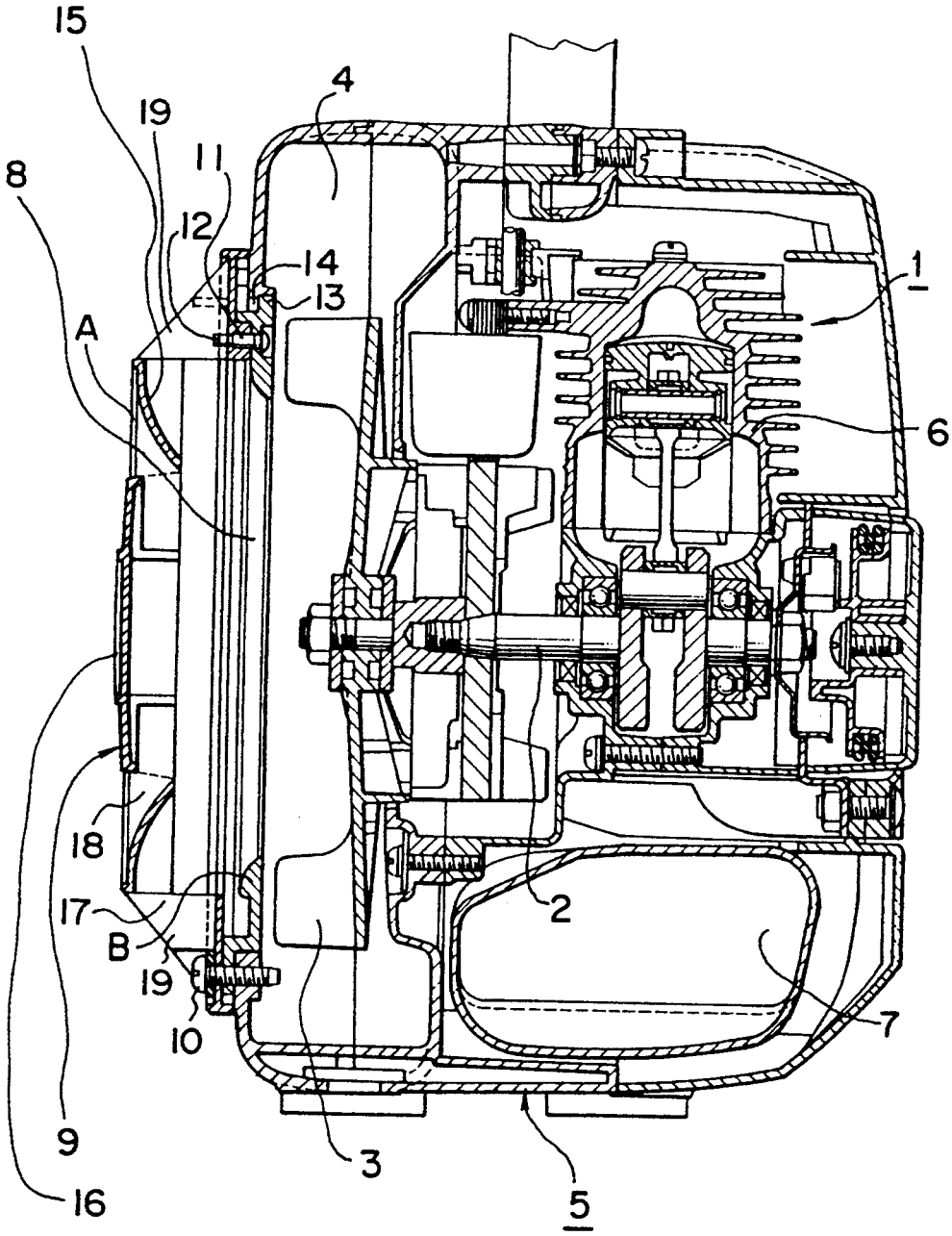
FIG. 1 is a vertical sectional view of an embodiment of a fan apparatus according to the present invention.

A fan apparatus according to the present invention will now be described with respect to the illustrated embodiment thereof. The embodiment shown in FIG. 1 is a power blower suitable for cleaning, snow removal, or pool-water dissipation on a playground, baseball ground, etc. The components of the power blower which are not directly relevant to the present invention, such as an air pipe for mounting on a compressed-air discharge port, are not illustrated.

The power blower shown in FIG. 1 has a lightweight engine 1, such as an air-cooled two-stroke-cycle gasoline engine. A centrifugal fan rotor 3 is mounted on an output shaft 2 of the engine 1, and is accommodated in a volute casing 4, so that the rotation of the centrifugal fan rotor 3 causes air to be pressure-delivered. The air pressure-delivered from the volute casing 4 reaches a discharge port, and passes through an air pipe (neither of which are shown) to be used in an operation, such as ground cleaning, snow removal, pool-water dissipation.

The lightweight engine 1 is accommodated in a body housing 5, in which a cylinder 6, a fuel tank 7, and other unillustrated components, such as a spark plug, a diaphragm carburetor, an air-cleaner for the carburetor and a muffler, are provided.

The body housing 5 has a circular opening formed therein at a position facing the centrifugal fan rotor 3, the opening constituting an air suction port 8. A suction port cover 9 is mounted over the air suction port 8 by using a screw 10.

Figure 2:
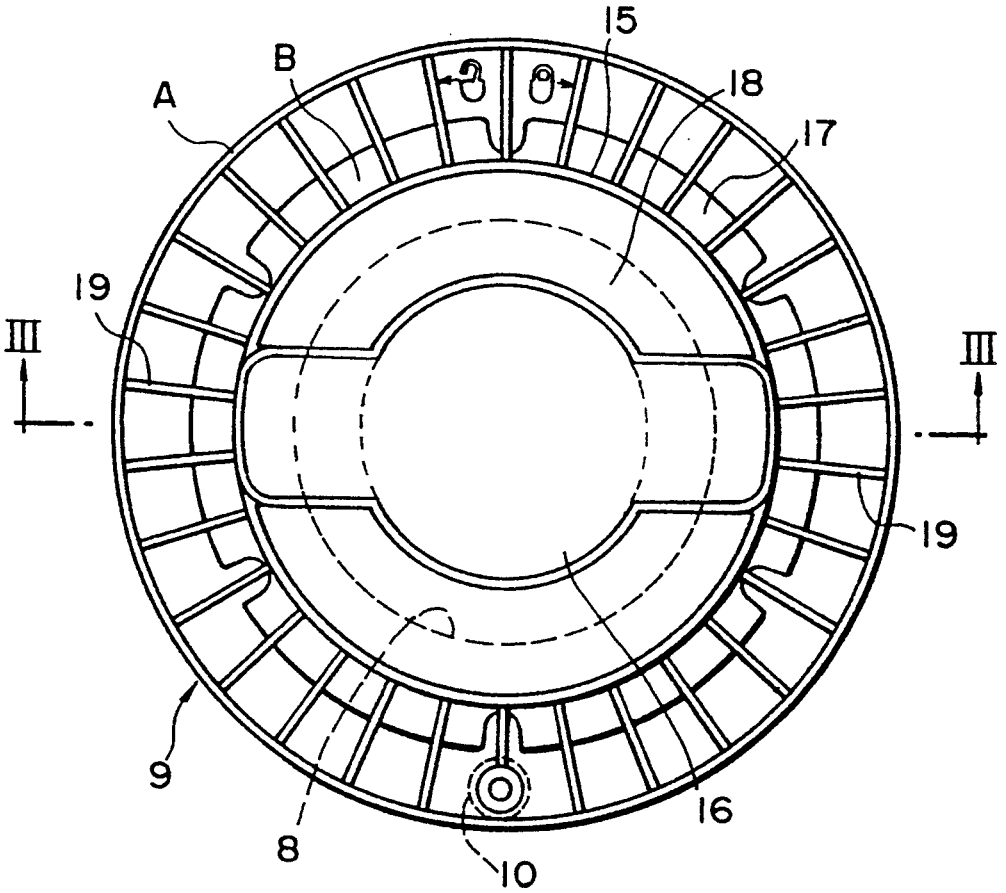
FIG. 2 is a front view of a suction port cover of the embodiment shown in FIG. 1.
Figure 3:
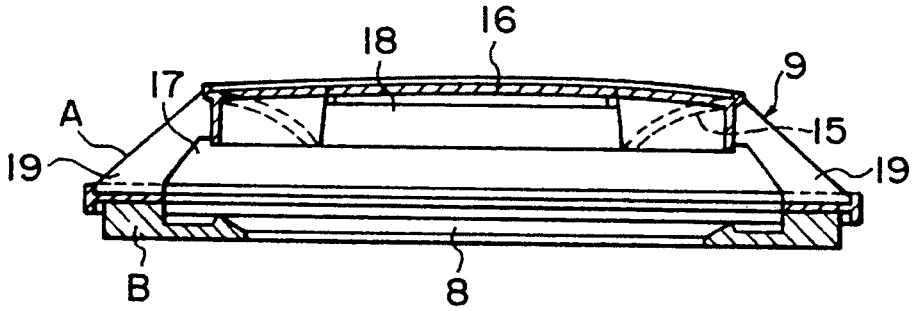
FIG. 3 is a sectional view taken along the line III—III shown in FIG. 2.

The suction port cover 9 will be described in detail. The suction port cover 9 mainly comprises a cover body A and an auxiliary member B, which are integrated together by fastening them with pins 11 passed through pin holes 12. In order that the suction port cover 9 be dismountably mounted over the air suction port 8, the outer peripheral edge of the auxiliary member B has, for example, three projections 13 formed thereon, and the inner peripheral edge of the air suction port 8 has notches 14 correspondingly formed therein, the projections 13 being engageable with and disengageable from the notches 14. When the suction port cover 9 is rotated relative to the air suction port 8, the projections 13 and the notches 14 are either engaged or disengaged, whereby the suction port cover 9 is either locked onto or unlocked from the body casing 5. The direction in which the suction port cover 9 should be rotated for the purpose of locking, and the direction of rotation for the purpose of unlocking are indicated, as shown in FIG. 2, by illustrations of locks provided at an upper portion of the outer surface of the cover body A. In the example shown in FIG. 2, when the suction port cover 9 is rotated in the clockwise direction, as viewed in FIG. 2, with the projections 13 fitted in the notches 14, and, thereafter, the screw 10 is threaded, the suction port cover 9 is fixed to the body casing 5 over the air suction port 8. When the suction port cover 9 is to be dismounted from the air suction port 8, the screw 10 is removed, and, thereafter, the fan cover 9 is rotated in the unlocking direction.

The cover body A includes a bell-mouth shaped member 15 for guiding air being sucked into the air suction port 8 in such a manner that air is introduced in every radial direction from the side of the suction port cover 9. Specifically, the bell-mouth shaped member 15 is supported by a plurality of straightening ribs 19 arranged in correspondence with the circumference of the air suction port 8 and at intervals small enough for preventing the entrance of a finger, and a first suction passage 17 is defined by the inner surface of the bell-mouth shaped member 15. The cover body A also includes a blind patch member 16 extending across the space defined by the outer surface of the bell-mouth shaped member 15, and having ends integrally secured to the bell-mouth shaped member 15. In the example shown in FIG. 2, the blind patch member 16 extends horizontally. The blind patch member 16 comprises a plate-shaped member disposed in that space with a gap between the blind patch member 16 and an outer, convex surface of the bell-mouth shaped member 15 so that an auxiliary second suction passage 18 is defined therebetween. The opening thus formed at the entrance of the second suction passage 18 provides a handhold.

Therefore, when the suction port cover 9 is to be mounted over or dismounted from the air suction port 8, the suction port cover 9 can be rotated by holding, in the illustrated example, upper and lower portions of the blind patch member 16. Thus, the mounting or dismounting operation can be performed safely and easily.

As shown in FIGS. 1 and 2, the air suction port 8 is completely covered with the bell-mouth shaped member 15 and the blind patch member 16, thereby making it possible to effectively restrain noise from leaking outside. As shown in FIG. 2, the blind patch member 16 can also serve as a space for labelling.

What is claimed is:

1. A fan apparatus comprising: a volute casing; a fan rotor rotatably arranged in said volute casing; an air suction port having a first bell-mouth on said casing for said fan rotor; and an air suction port cover removably provided outside of said volute casing at said air suction port, said air suction port cover comprising: a bell-mouth shaped member having a second bell-mouth with an arc shaped cross section and formed with an inner bell-mouth surface and an outer bell-mouth surface for guiding air being sucked into said casing through said air suction port in such a manner that air is introduced from a radial side of said air suction port cover, said inner bell-mouth surface defining a first suction passage between said first bell-mouth; and a blind patch member disposed in the space defined by said outer bell-mouth surface with a gap between said blind patch member and said outer bell-mouth surface of said bell-mouth so that a second suction passage is defined therebetween.

2. A fan apparatus according to claim 1, wherein said inner bell-mouth surface and said outer bell-mouth surface each extend outwardly from an inner central portion of said port cover facing said fan rotor to an outer side of said port cover proximate to said radial side.

* * * * *